US007494240B1

(12) United States Patent
Lin

(10) Patent No.: US 7,494,240 B1
(45) Date of Patent: Feb. 24, 2009

(54) LIGHTING FIXTURE ASSEMBLY

(76) Inventor: Tung Hsiung Lin, NO1, Alley 16, Lane40, Jinde Rd., East District, Taichung City40141 (TW)

( * ) Notice: Subject to any disclaimer, the term of this patent is extended or adjusted under 35 U.S.C. 154(b) by 134 days.

(21) Appl. No.: 11/638,107

(22) Filed: Dec. 12, 2006

(51) Int. Cl.
*F21V 21/00* (2006.01)

(52) U.S. Cl. ..... 362/215; 362/260; 439/229; 439/232

(58) Field of Classification Search ..... 362/216, 362/225, 260; 313/318.02, 318.09; 439/229, 439/232
See application file for complete search history.

(56) References Cited

U.S. PATENT DOCUMENTS 6,307,316 B1 * 10/2001 Holzer ..... 313/493
6,561,828 B2 * 5/2003 Henrici et al. ..... 439/239
6,583,543 B1 * 6/2003 Itaya et al. ..... 313/318.11
6,824,409 B2 * 11/2004 Thiele et al. ..... 439/242
7,137,728 B2 * 11/2006 Witham et al. ..... 362/652
7,168,970 B2 * 1/2007 Thiele et al. ..... 439/226
7,202,614 B2 * 4/2007 Bayat et al. ..... 315/324
7,344,397 B2 * 3/2008 Miyazono ..... 439/232
2003/0210550 A1 * 11/2003 Matsuba et al. ..... 362/363

* cited by examiner

*Primary Examiner*—Jong-Suk (James) Lee
*Assistant Examiner*—Peggy A. Neils
(74) *Attorney, Agent, or Firm*—Pro-Techtor Int'l Services

(57) ABSTRACT

A lighting fixture assembly includes a base having a plate and a peripheral wall which has recesses defined in an inner periphery thereof. The plate has connection slots in which V-shaped clamp members are respectively received. Each clamp member has a C-shaped connection end which includes an opening and two extensions extend from two ends of the connection end at an angle. Two parts each have an insertion and a frame is connected on the insertion. Each frame is connected with light tubes thereon. Each insertion has protrusions for being engaged with the recesses and positioning rods for being slidably inserted through the connection slots and engaged with the V-shaped clamp members. The two parts can be replaced by different shapes of parts.

5 Claims, 11 Drawing Sheets

LIGHTING FIXTURE ASSEMBLY

FIELD OF THE INVENTION

The present invention relates to a lighting fixture assembly which is easily assembled and cooperated with multiple light tubes.

BACKGROUND OF THE INVENTION

A conventional lighting fixture for being cooperated with U-shaped light tubes generally includes a main body which is includes a plurality of connection ports for being connected with the U-shaped tubes. The body cannot be changed and the positions of the connection ports are fixed so that the users can only connect the U-shaped light tubes to the connection ports. The users do not have many options when purchasing in the market to have a lighting fixture that provides the users to assemble different shapes of frame for holding the light tubes.

The present invention intends to provide a lighting fixture which is composed of a base with connection slots and at least two frames are optionally connected with the connection slots and each frame can be connected with multiple light tubes.

SUMMARY OF THE INVENTION

The present invention relates to a lighting fixture assembly which comprises a base having a plate with connection slots defined therethrough and a peripheral wall extends perpendicularly from the plate. A plurality of recesses are defined in an inner periphery of the peripheral wall. A plurality of substantially V-shaped clamp members are received in the connection slots and each clamp member has a C-shaped connection end which includes an opening, and two extensions extend from two ends of the connection end at an angle. Each extension has a groove defined in an inside thereof.

A first part has a first insertion and a plurality of first protrusions extending radially from an outer periphery of the first insertion so as to be engaged with the recesses of the peripheral wall. A first frame is connected on a top of the first insertion and a plurality of first connection ports are defined in the first frame for receiving light tubes. A plurality of first positioning rods extend from an underside of the first insertion and are slidably inserted into the first connection slots. A second part has a second insertion and a plurality of second protrusions extend radially from an outer periphery of the second insertion. A second frame is connected on a top of the second insertion and a plurality of second connection ports are defined in the second frame so as to be connected with light tubes. A plurality of second positioning rods extend from an underside of the second insertion. The second protrusions are slidably engaged with the recesses and the second positioning rods are slidably inserted into the first connection slots. The first and second parts are simultaneously rotated an angle to move the first and second positioning rods into the C-shaped connection ends via the respective openings of the V-shaped clamp members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
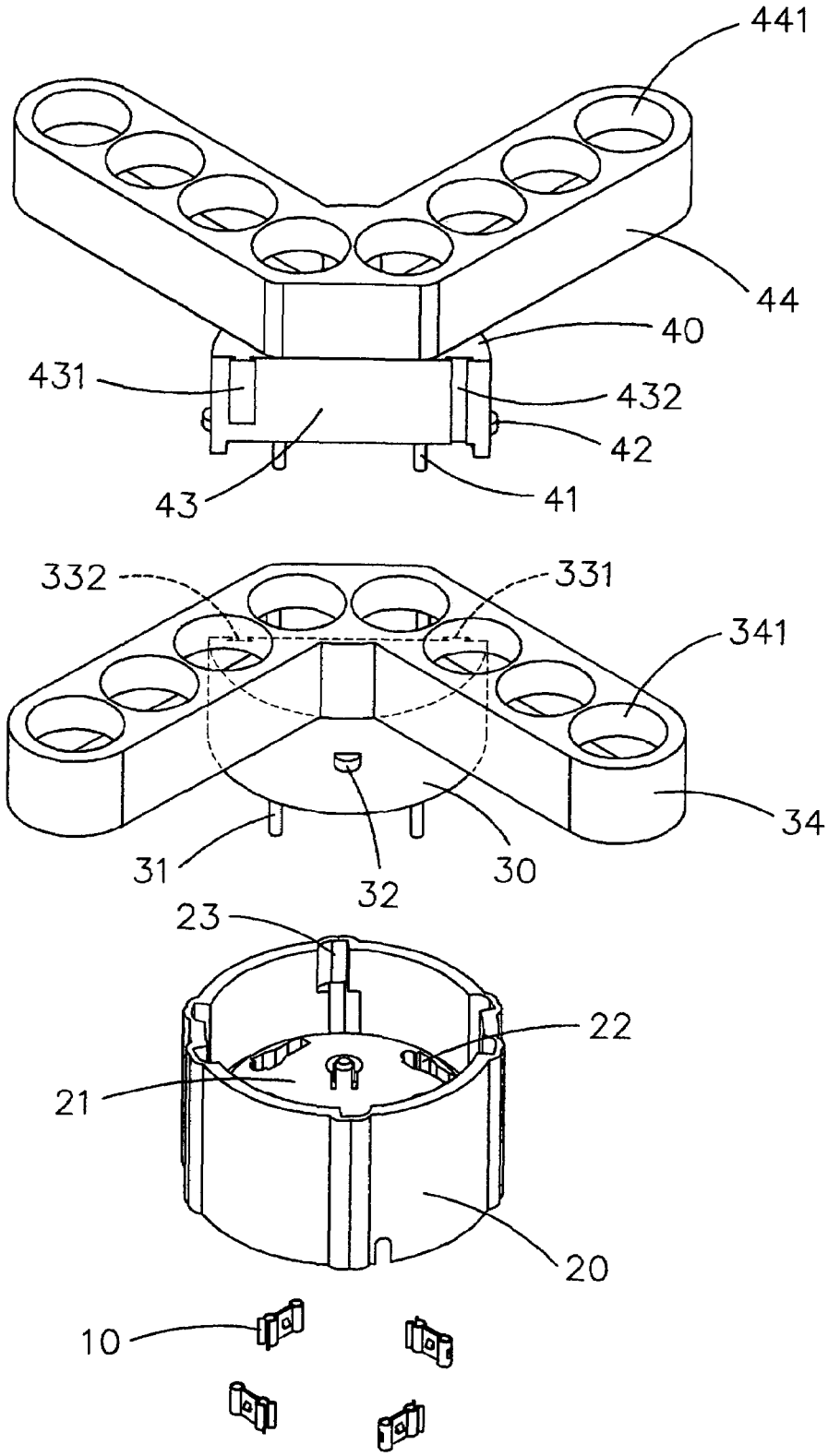
FIG. 1 is an exploded view to show the lighting fixture assembly of the present invention.
Figure 2:
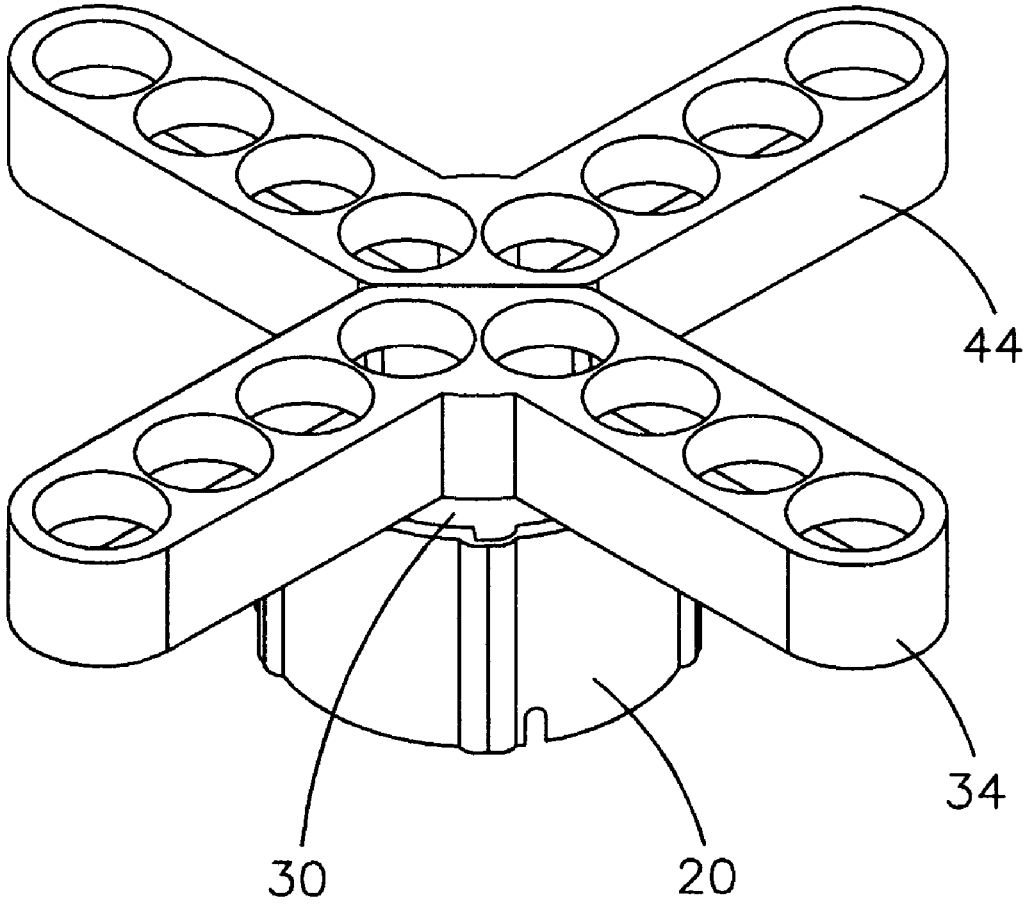
FIG. 2 is a perspective view to show the lighting fixture assembly of the present invention.
Figure 3:
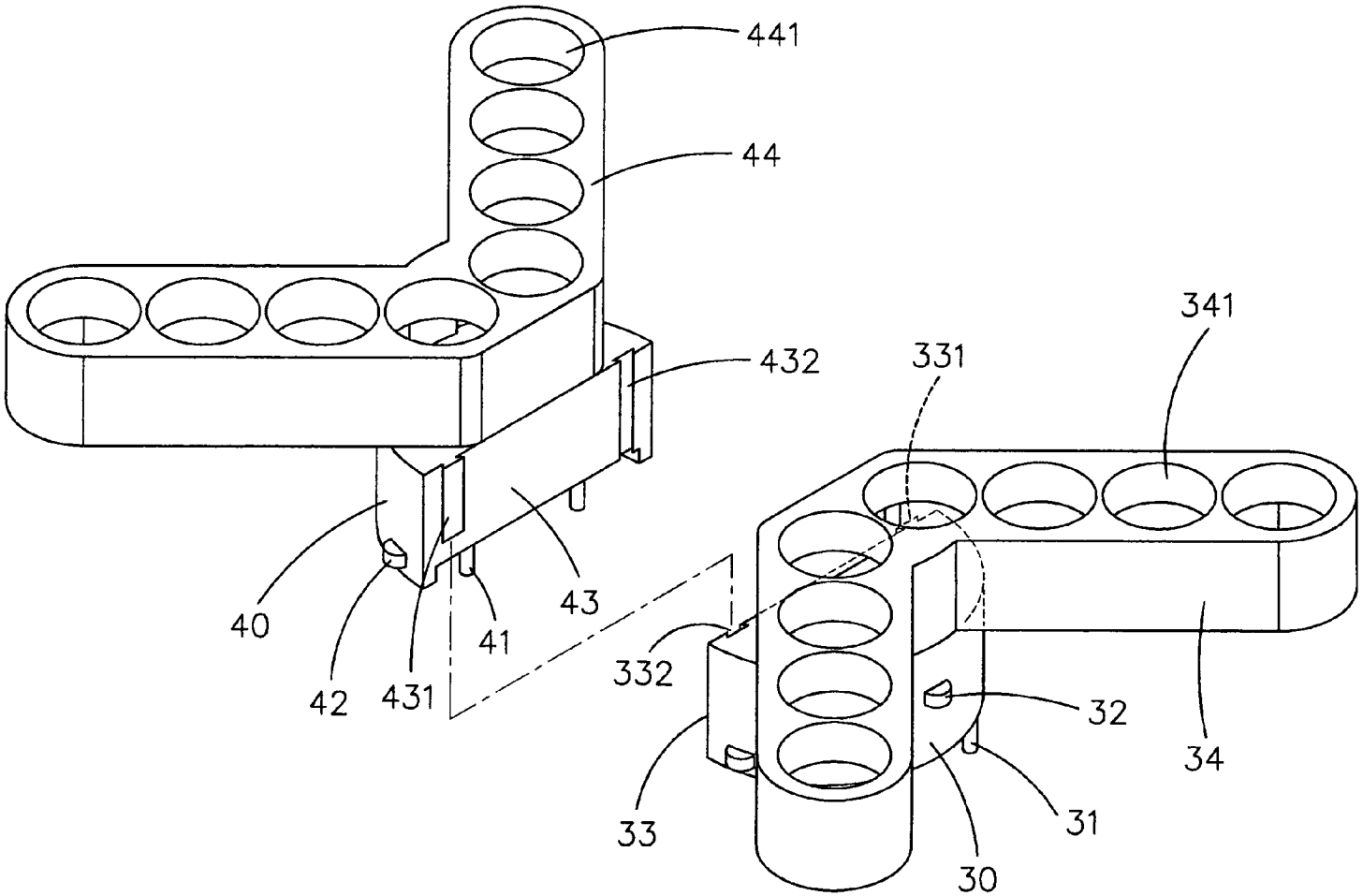
FIG. 3 shows the first part and the second part of the lighting fixture assembly of the present invention.
Figure 4A:
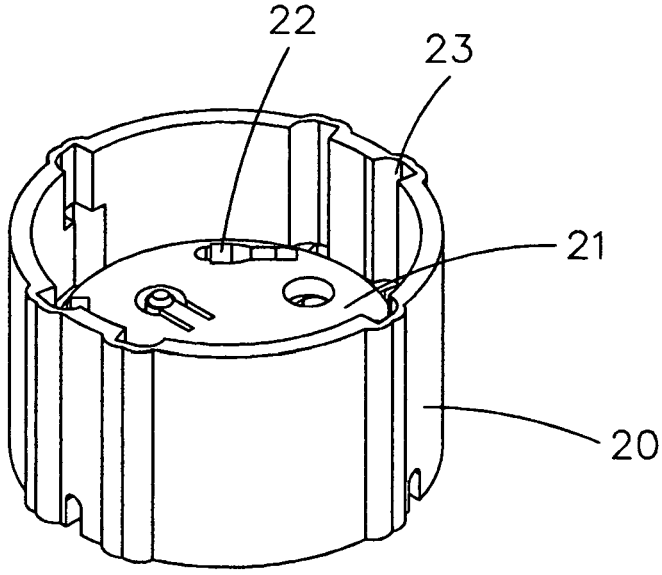
FIG. 4A shows the perspective view of the base of the lighting fixture assembly of the present invention.
Figure 4B:
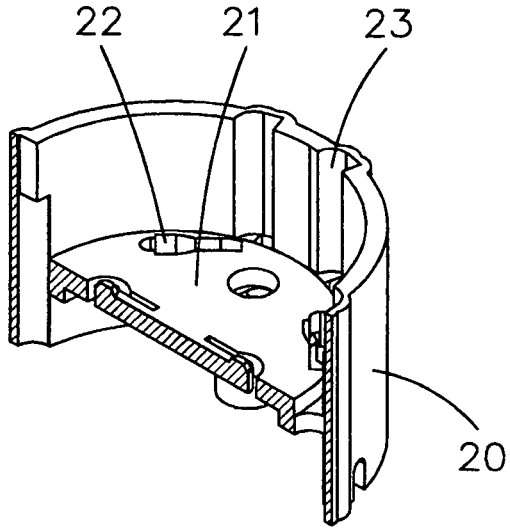
FIG. 4B shows the cross sectional view, partly removed, of the base of the lighting fixture assembly of the present invention.

Referring to FIGS. 1-3, 4A, 4B, 5, 6A and 6B, the lighting fixture assembly of the present invention comprises a base 20 having a plate 21 and a circular peripheral wall extends perpendicularly from the plate 21. A plurality of recesses 23 defined in an inner periphery of the peripheral wall and a plurality of connection slots 22 are defined through the plate 21. A plurality of substantially V-shaped clamp members 10 are received in the connection slots 22 and each clamp member 10 has a C-shaped connection end 11 which includes an opening 12. Two extensions 13 extend from two ends of the connection end 11 at an angle so that the two extensions 13 have flexibility and can be pushed inward and outward. Each extension 13 has a groove 132 defined in an inside thereof. Each extension 13 of each of the V-shaped clamp members 10 has a first stub 14 which splits outward from the extension 13 and forms a first opening 131. The C-shaped connection end 11 of each of the V-shaped clamp members 10 has a second stub 112 which splits inward from the C-shaped connection end 11 and forms a second opening 111.

Figure 5:
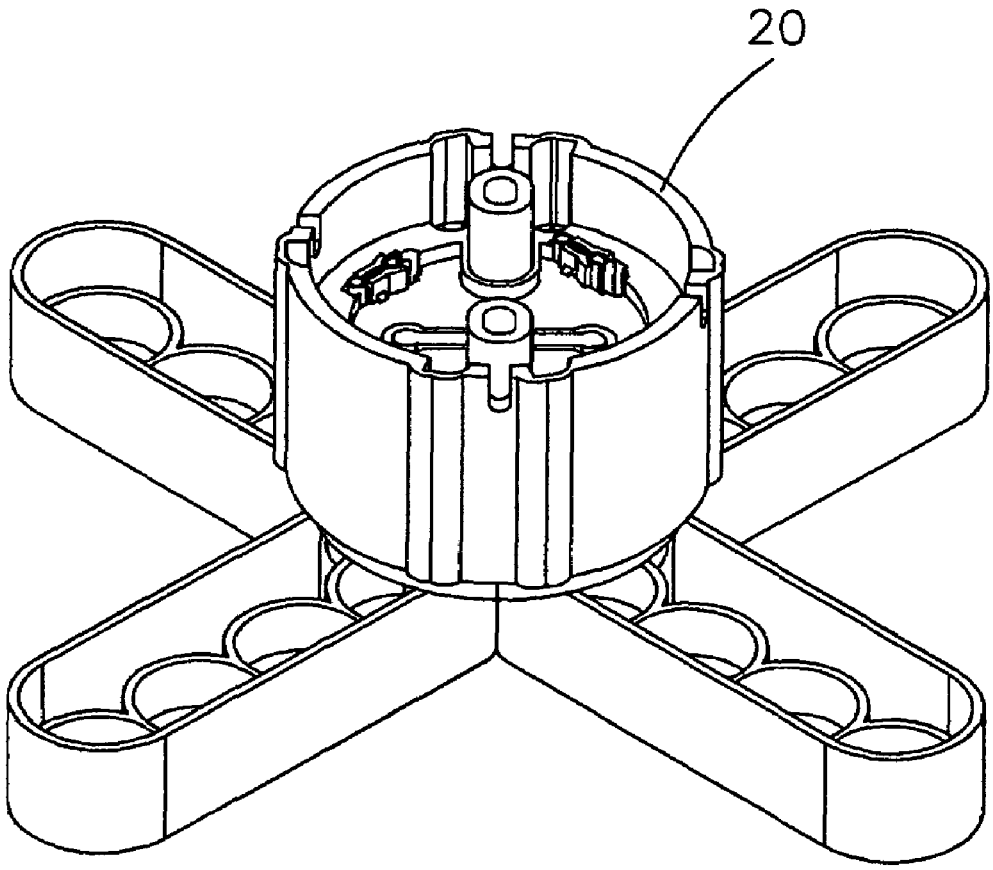
FIG. 5 shows the underside of the lighting fixture assembly of the present invention.
Figure 6A:
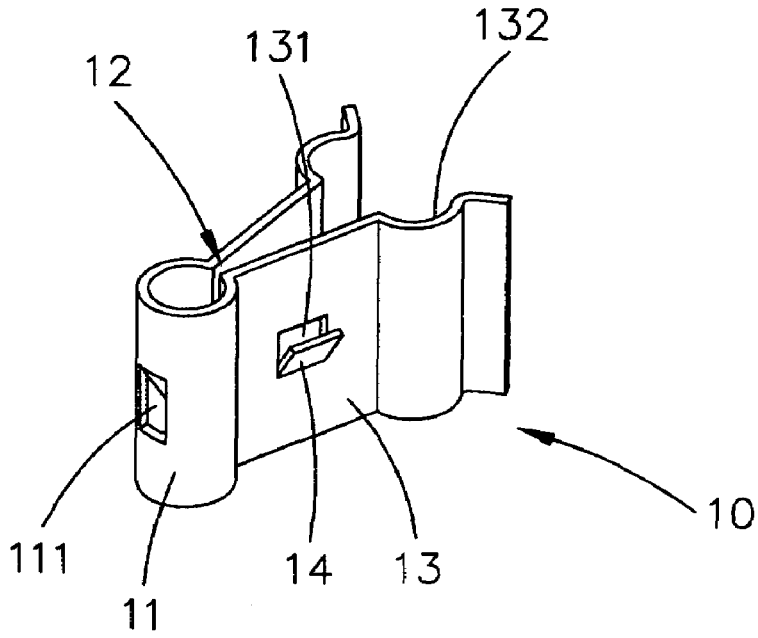
FIG. 6A shows the V-shaped clamp member of the lighting fixture assembly of the present invention.
Figure 6B:
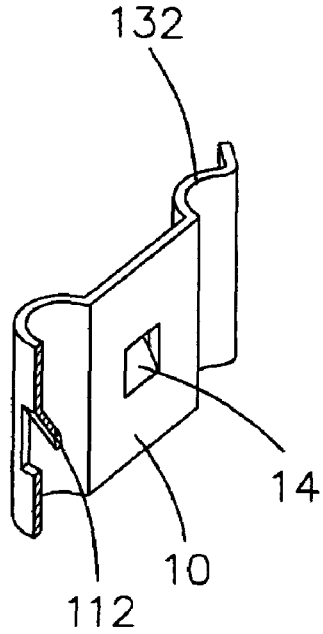
FIG. 6B shows half of the V-shaped clamp member of the lighting fixture assembly of the present invention.
Figure 7:
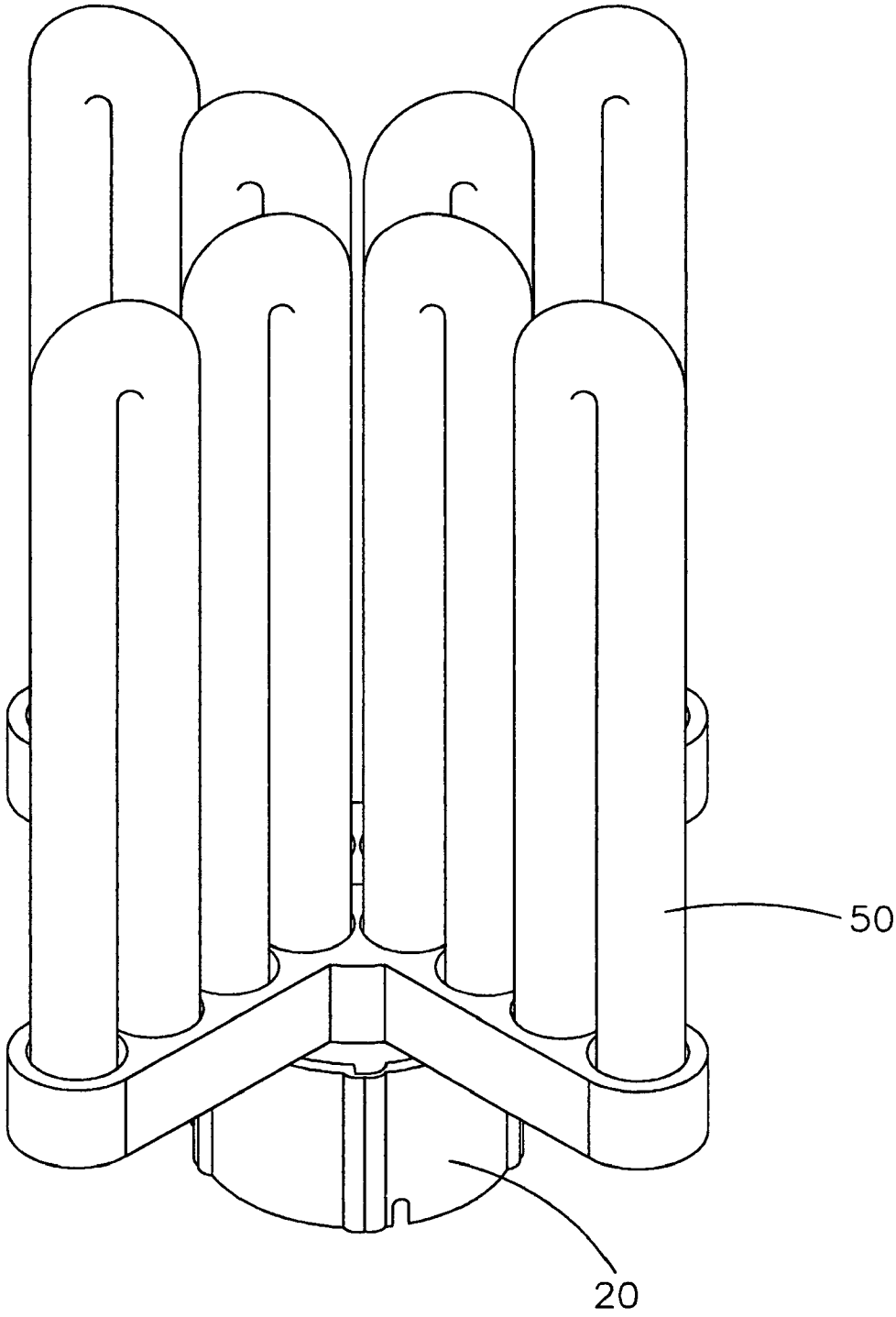
FIG. 7 shows light tubes are connected to the lighting fixture assembly of the present invention.
Figure 8:
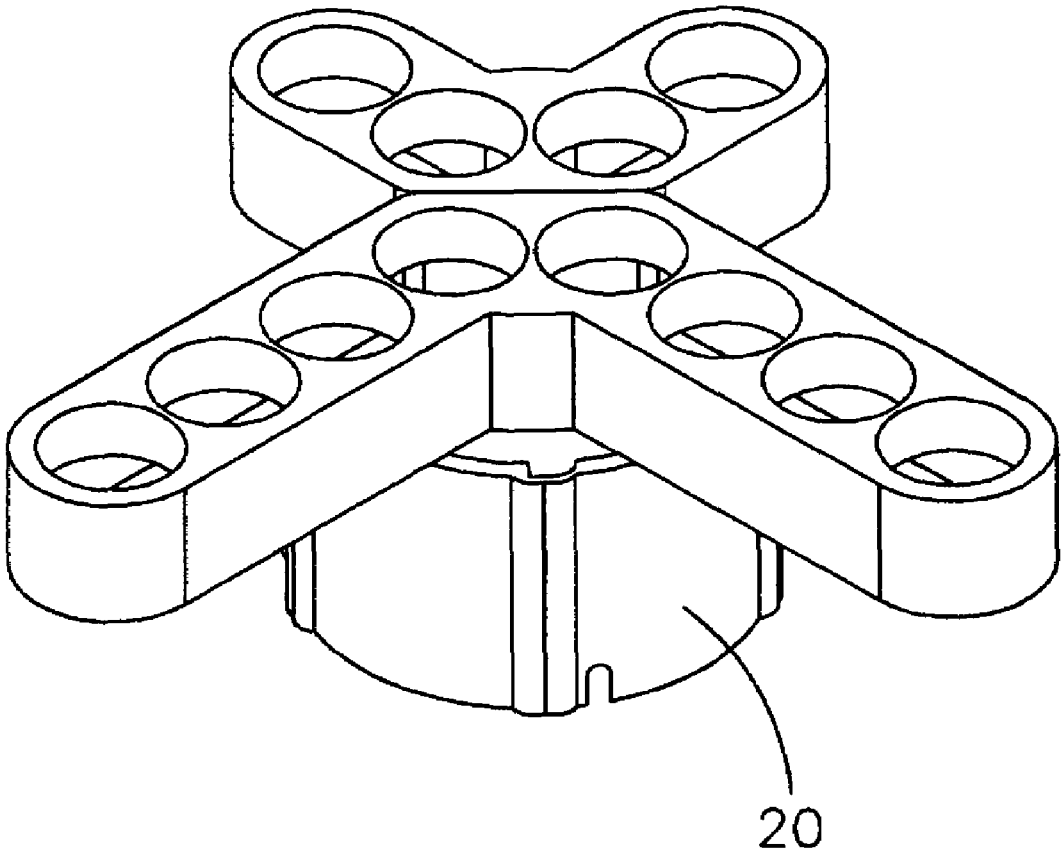
FIGS. 8-11 show four different embodiment of the lighting fixture assembly of the present invention.
Figure 9:
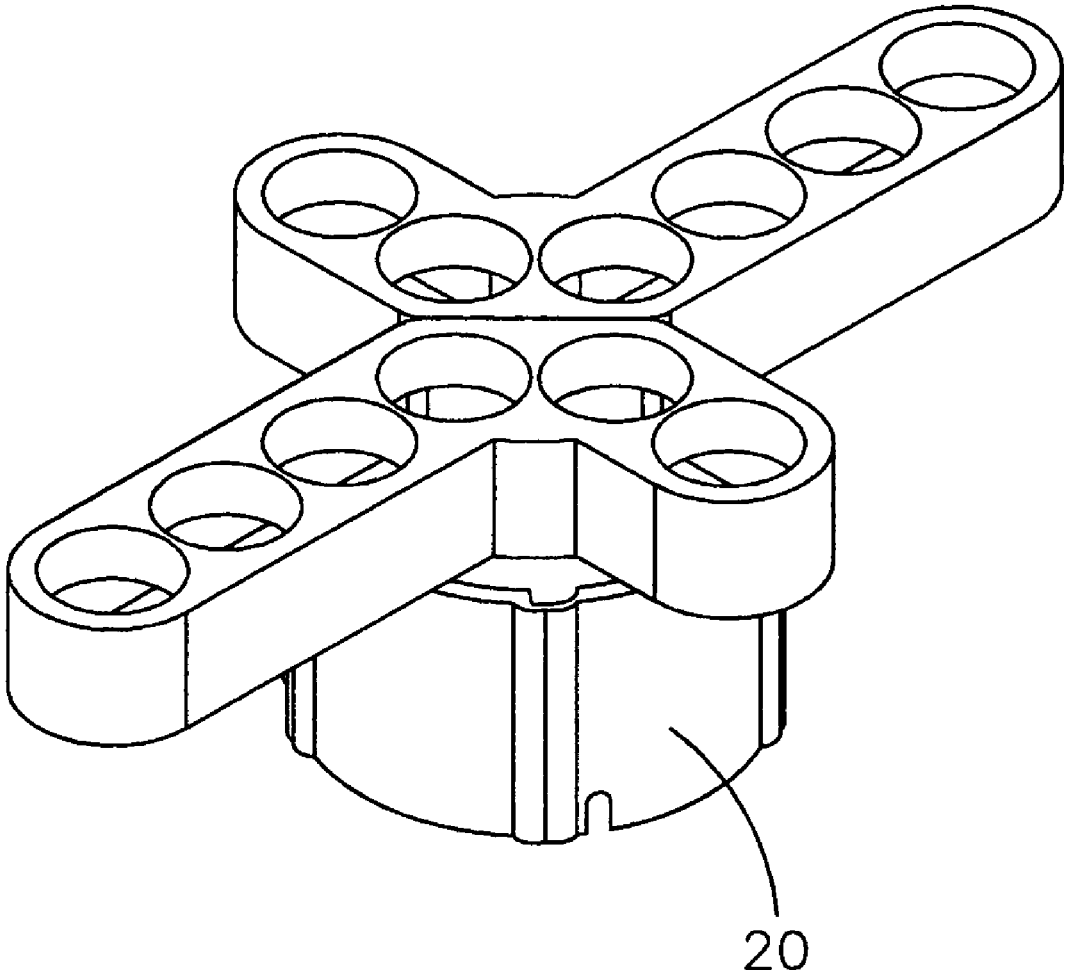
Figure 10:
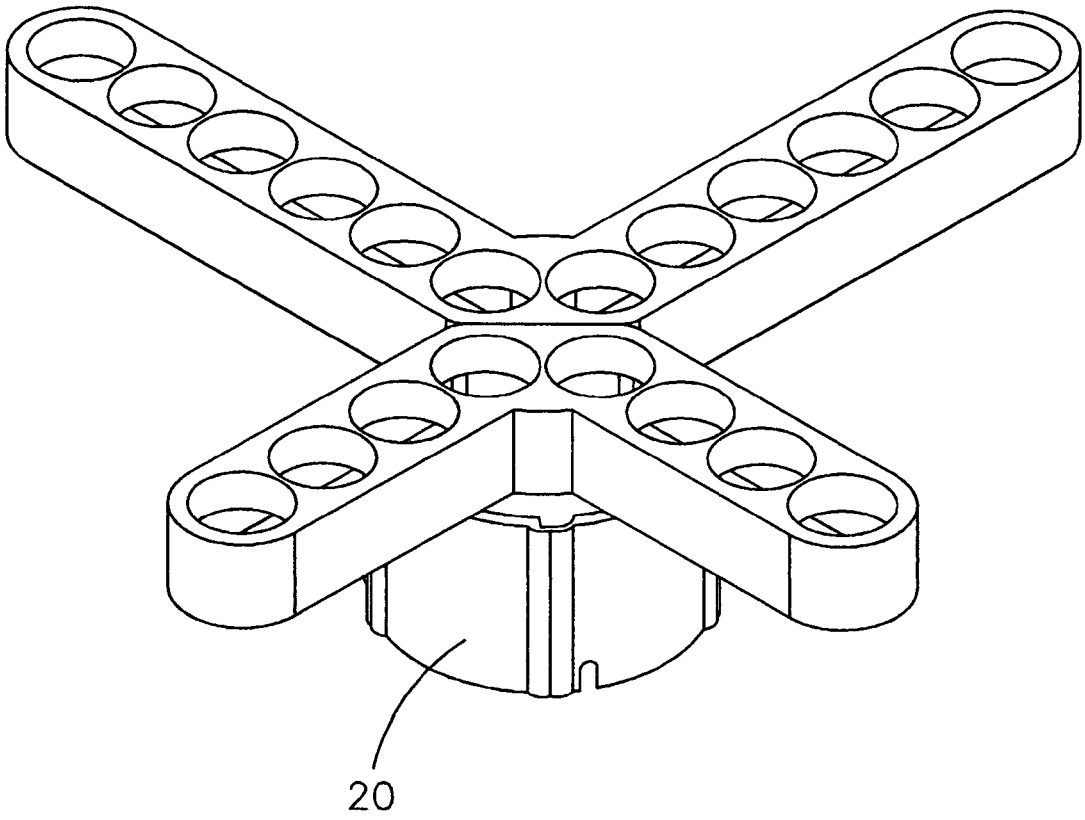
Figure 11:
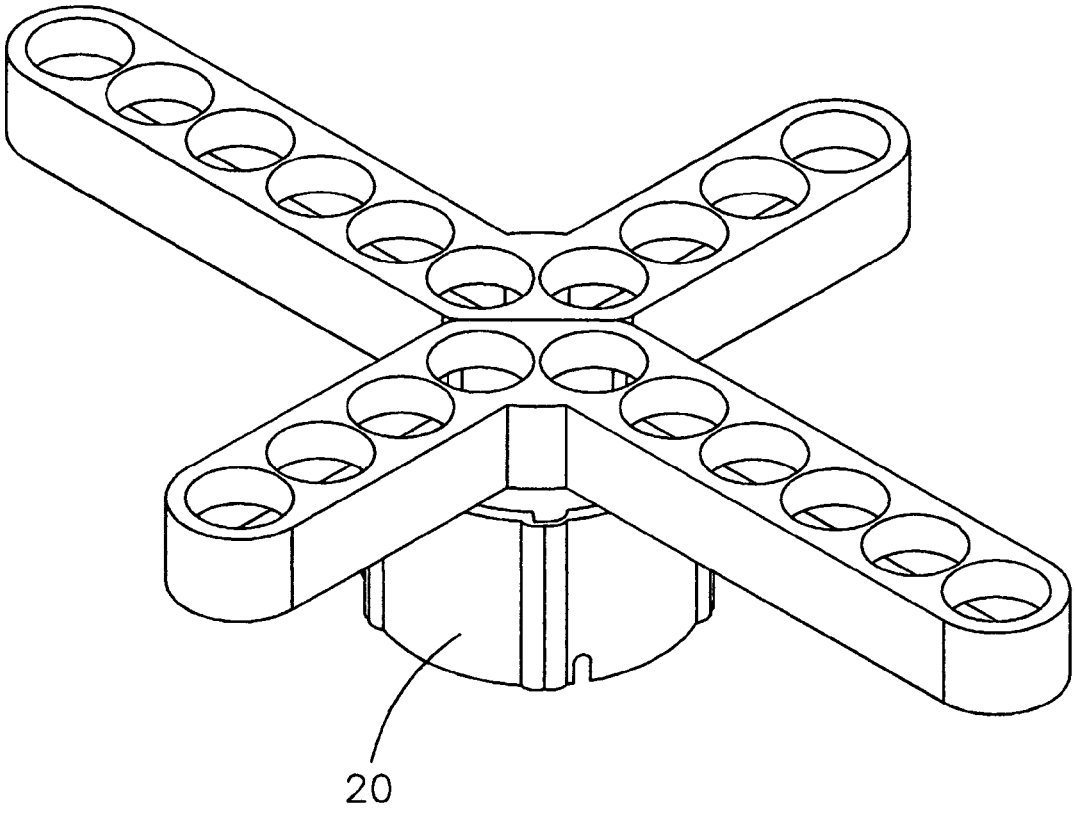

A first part 30 has a first insertion and a plurality of first protrusions 32 extending radially from an outer periphery of the first insertion. The first insertion includes a first connection surface 33 and a first ridge 331 extends from the first connection surface 33, and a first engaging groove 332 is defined in the first connection surface 33. A first frame 34 is a substantially V-shaped frame and connected on a top of the first insertion. A plurality of first connection ports 341 are defined in the first frame 34 so as to connect light tubes 50 as shown in FIG. 5. A plurality of first positioning rods 31 extend from an underside of the first insertion. The first protrusions 32 are slidably engaged with the recesses 23 and the first positioning rods 31 are slidably inserted into the first connection slots 22 and engaged with the grooves 132 of the extensions 13.

A second part 40 has a second insertion and a plurality of second protrusions 42 extend radially from an outer periphery of the second insertion. A substantially V-shaped second frame 44 is connected on a top of the second insertion and a plurality of second connection ports 441 are defined in the second frame 44. A plurality of light tubes 50 as shown in FIG. 5 are connected with the second connection ports 441. A plurality of second positioning rods 41 extend from an underside of the second insertion. The second insertion includes a second connection surface 43 and a second ridge 431 extends from the second connection surface 43, and a second engaging groove 432 is defined in the second connection surface 43. The first ridge 331 is engaged with the second engaging groove 432 and the second ridge 431 is engaged with the first engaging groove 332 so that the first and second insertions are matched with each other as a one piece.

The second protrusions 42 are slidably engaged with the recesses 23 and the second positioning rods 41 are slidably inserted into the first connection slots 22 and are engaged with the grooves 132 of the V-shaped clamp members 10. The first and second parts 30, 40 are then simultaneously rotated an angle to move the first and second positioning rods 31, 41 into the C-shaped connection ends 11 via the respective openings 12 of the V-shaped clamp members 10.

The first stubs 14 assist the V-shaped clamp members 10 to be positioned in the connection slots 22 and the second stub 112 is located between the first and second positioning rods 31, 41 to prevent the first and second positioning rods 31, 41 from being tangled to each other.

As shown in FIGS. 8-11, the first and second frames 34, 44 can be any shape and the number of the first and second connection ports 341, 441 can be varied as needed.

While we have shown and described the embodiment in accordance with the present invention, it should be clear to those skilled in the art that further embodiments may be made without departing from the scope of the present invention.

What is claimed is:

1. A lighting fixture assembly comprising:

a base having a plate and a peripheral wall extending perpendicularly from the plate and a plurality of recesses defined in an inner periphery of the peripheral wall, a plurality of connection slots defined through the plate;

a plurality of substantially V-shaped clamp members received in the connection slots and each clamp member having a C-shaped connection end which includes an opening, two extensions extending from two ends of the connection end at an angle;

a first part having a first insertion and a plurality of first protrusions extending radially from an outer periphery of the first insertion, a first frame connected on a top of the first insertion and a plurality of first connection ports for receipt of light tubes defined in the first frame, a plurality of first positioning rods extending from an underside of the first insertion, the first protrusions slidably engaged with the recesses and the first positioning rods slidably inserted into the connection slots, and a second part having a second insertion and a plurality of second protrusions extending radially from an outer periphery of the second insertion, a second frame connected on a top of the second insertion and a plurality of second connection ports for receipt of light tubes defined in the second frame, a plurality of second positioning rods extending from an underside of the second insertion, the second protrusions slidably engaged with the recesses and the second positioning rods slidably inserted into the connection slots, the first and second parts simultaneously rotated an angle to move the first and second positioning rods into the C-shaped connection ends via the respective openings of the V-shaped clamp members.

2. The assembly as claimed in claim 1, wherein each extension has a groove defined in an inside thereof.

3. The assembly as claimed in claim 1, wherein the first insertion includes a first connection surface and a first ridge extends from the first connection surface, a first engaging groove is defined in the first connection surface, the second insertion includes a second connection surface and a second ridge extends from the second connection surface, a second engaging groove is defined in the second connection surface, the first ridge is engaged with the second engaging groove and the second ridge is engaged with the first engaging groove.

4. The assembly as claimed in claim 1, wherein each extension of each of the V-shaped clamp members has a first stub which splits outward from the extension and forms a first opening.

5. The assembly as claimed in claim 1, wherein the C-shaped connection end of each of the V-shaped clamp members has a second stub which splits inward from the C-shaped connection end and forms a second opening.

* * * * *